US009917381B1

(12) United States Patent
Campbell et al.

(10) Patent No.: US 9,917,381 B1
(45) Date of Patent: Mar. 13, 2018

(54) ELECTRICAL CONNECTOR WITH A TERMINAL POSITION ASSURANCE DEVICE HAVING RIGID AND FLEXIBLE LOCKING FEATURES

(71) Applicant: Delphi Technologies, Inc., Troy, MI (US)

(72) Inventors: Jeffrey Scott Campbell, West Bloomfield, MI (US); Wesley W. Weber, Jr., Metamora, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/432,001

(22) Filed: Feb. 14, 2017

(51) Int. Cl.

| | |
|---|---|
| ***H01R 13/514*** | (2006.01) |
| ***H01R 9/16*** | (2006.01) |
| ***H01R 9/24*** | (2006.01) |
| ***H01R 13/436*** | (2006.01) |

(52) U.S. Cl.
CPC ..... *H01R 9/16* (2013.01); *H01R 9/24* (2013.01); *H01R 13/4362* (2013.01)

(58) Field of Classification Search
CPC ..... H01R 9/16; H01R 9/24; H01R 13/514; H01R 13/516; H01R 13/518; H01R 13/627; H01R 13/4223; H01R 13/4226; H01R 13/4362; H01R 13/6271; H01R 13/6275
USPC ..... 439/352, 713, 752
See application file for complete search history.

(56) References Cited

U.S. PATENT DOCUMENTS

| | | | | |
|---|---|---|---|---|
| 5,044,991 | A | 9/1991 | Colleran et al. | |
| 5,116,236 | A | 5/1992 | Colleran et al. | |
| 5,122,080 | A | 6/1992 | Hatagishi | |
| 5,358,427 | A | 10/1994 | Miwa et al. | |
| 5,609,503 | A | 3/1997 | Tsuji | |
| 5,653,613 | A | 8/1997 | Shimoda | |
| 5,830,013 | A | 11/1998 | Saito et al. | |
| 5,839,923 | A | 11/1998 | Yoshida | |
| 6,010,374 | A | 1/2000 | Miwa | |
| 6,066,008 | A * | 5/2000 | Brantingham | H01R 13/4362 439/595 |
| 6,132,252 | A | 10/2000 | Chaillot | |
| 6,648,699 | B1 | 11/2003 | Makino et al. | |

(Continued)

FOREIGN PATENT DOCUMENTS

| | | | |
|---|---|---|---|
| EP | 1047153 | A1 | 10/2000 |
| WO | 2007060683 | A1 | 5/2007 |

*Primary Examiner* — Chandrika Prasad
(74) *Attorney, Agent, or Firm* — Robert J. Myers

(57) ABSTRACT

An electrical connector including electrical terminals along with a connector housing defining a first and second cavity, the first and second cavities configured to receive the terminals. The connector housing further defines a third cavity extending along a lateral axis. The electrical connector includes a terminal position assurance (TPA) device received within the third cavity. The TPA device is moveable from an terminal insertion position to a terminal locking position. The TPA device has flexible first and second primary locking features and rigid first and second secondary locking features configured to engage locking features of the terminals. Only the first primary and first secondary locking features engage the locking surface of the first electrical terminal and only the second primary and second secondary locking features engage the locking surface of the second electrical terminal when the TPA device is in the terminal locking position.

10 Claims, 6 Drawing Sheets

(56) References Cited

U.S. PATENT DOCUMENTS

| | | | | |
|---|---|---|---|---|
| 7,179,136 | B1 * | 2/2007 | Morello | H01R 13/4223 439/140 |
| 7,396,255 | B2 | 7/2008 | Morello et al. | |
| 7,556,539 | B2 | 7/2009 | Takahashi et al. | |
| 7,717,758 | B2 | 5/2010 | Fukamachi | |
| 8,210,864 | B1 | 7/2012 | Hernandez et al. | |
| 9,407,026 | B2 * | 8/2016 | Campbell | H01R 13/4362 |
| 2010/0256752 | A1 | 10/2010 | Forster et al. | |
| 2016/0013575 | A1 * | 1/2016 | Campbell | H01R 13/4362 439/752 |

* cited by examiner

ELECTRICAL CONNECTOR WITH A TERMINAL POSITION ASSURANCE DEVICE HAVING RIGID AND FLEXIBLE LOCKING FEATURES

TECHNICAL FIELD OF THE INVENTION

The invention relates to electrical connectors, and more particularly relates to an electrical connector including a terminal position assurance device having two sets of terminal locking features.

BACKGROUND OF THE INVENTION

Electrical terminals locked into a connector housing are subject to retention strength performance issues, especially with the smaller size categories of terminals (e.g. less than 2.8 mm). These smaller terminals historically have used scaled down locking features, which inherently have reduced locking retention strength and allow excessive terminal float. An excessively floating terminal can stub during mating, resulting in the terminal pushing out, and/or terminal damage especially if the retention strength within the connector housing is low. Within the automotive industry, inadequately locked terminals which pull out or push out, are recognized as the second highest root cause for failure of electrical connector systems within the vehicle warranty period.

Electrical connectors typically comprise internal cavities that are intended to accommodate electrical (male and/or female) terminals inserted from a rear face of the electrical connector. To ensure a well and safe functioning of the connector, it has to be ensured that the electrical terminals are locked in place within the electrical connector.

A solution known in the art includes providing a primary locking feature in form of a resilient retaining shoulder for preventing rearward withdrawal of the electrical terminals. The retaining shoulder, which is formed in the electrical connector, is designed to make a snap fit into a corresponding recess of the electrical connector at the end of the insertion of the electrical connector. A flexible retaining member is thereby disposed contiguously between the internal cavity and a slot, into which the retaining member can deflect. The retaining shoulder is formed on the face of the flexible retaining member that communicates with the internal cavity, such that on inserting the electrical terminal into the internal cavity, the retaining member first deflects in the slot before the retaining shoulder engages the recess of the electrical terminal.

In order to secure the primary locking, it is known, e.g. from U.S. Pat. No. 6,132,252, to insert an additional locking member built as a rail into the slot next to the retaining member as a secondary locking. The electrical terminal being fully inserted into the internal cavity and the primary locking being engaged, the locking member is inserted into the slot from a front face of the electrical connector according to a direction corresponding to the loading direction of the electrical terminal. The retaining member is thus prevented from being flexed away from the internal cavity, thereby firmly retaining the electrical terminal. If the electrical terminal is incompletely inserted into the internal cavity, the retaining member is maintained in a deflected position into the slot, such that the locking member cannot be mounted.

The secondary locking mechanism known in the art requires a locking member being inserted frontward of the electrical connector in the direction opposite to that of the insertion of the electrical terminal. However, the configuration of the electrical connector may be such that a frontward insertion of the locking member is not possible, e.g. because there is not enough space at the front face side. In addition, the retaining members in connectors used with smaller terminals may easily buckle, terminal tangs may bend, and secondary locking mechanism may provide limited additional strength due to packaging constraints with terminals smaller than 2.8 mm. These solutions to date have only met the minimum terminal retention requirements, in many cases, all with little to no performance margin.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with an embodiment of the invention, an electrical connector is provided. The electrical connector includes a first electrical terminal and a second electrical terminal and a connector housing that defines a first cavity and a second cavity. The first and second cavity each extend along a longitudinal axis from a first face of the connector housing to a second face of the connector housing. The first and second electrical terminals are disposed within the first and second cavities respectively. The connector housing defines a third cavity that is in communication with the first and second cavities. The third cavity extends along a lateral axis transverse to the longitudinal axis. The electrical connector also includes a terminal position assurance (TPA) device that is disposed within the third cavity. The TPA device is moveable from a terminal insertion position to a terminal locking position. The TPA device comprises flexible first and second primary locking features that are configured to engage corresponding locking surfaces of the first and second electrical terminals respectively when the TPA device is in the terminal insertion position within the third cavity. The TPA device further comprises rigid first and second secondary locking features that are configured to engage the corresponding locking surfaces of the first and second electrical terminals respectively. Only the first primary and first secondary locking features engage the locking surface of the first electrical terminal when the TPA device is in the terminal locking position and only the second primary and second secondary locking features engage the locking surface of the second electrical terminal when the TPA device is in the terminal locking position.

The engagement of the first primary locking feature with the locking surface of the first terminal and the engagement of the second primary locking feature with the locking surface of the second terminal is effective to removably secure the first and second electrical terminals within the first and second cavities respectively. The engagement of the first secondary locking feature with the locking surface of the first terminal and the engagement of the second secondary locking feature with the locking surface of the second terminal is effective to irremovably secure the first and second electrical terminals within the first and second cavities respectively.

The TPA device is configured to move from the terminal insertion position to the terminal locking position along the lateral axis and move transversely relative to the longitudinal axis. The TPA device is configured to be inserted in the third cavity transversally to the first and second internal cavities through a lateral opening defined by the connector housing.

The first and second primary locking features comprise a flexible cantilever beam that is attached at one end to a cross bar of the TPA device and wherein a free end of the flexible beam defines a first lock shoulder. The electrical connector according to claim 6, wherein the first and second secondary locking features of the TPA device define a rigid second lock shoulder defined by the cross bar of the TPA device.

The first lock shoulder of the flexible beam engages the locking surface of the corresponding electrical terminal when the TPA devices is in the terminal insertion position and in the terminal locking position. The second lock shoulder engages the locking surface of the corresponding electrical terminal when the TPA devices is in the terminal locking position.

In accordance with another embodiment of the invention, a wire harness assembly is provided. The electrical connector includes the electrical connector described above and first and second wire cables connected to the first and second electrical terminals respectively.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
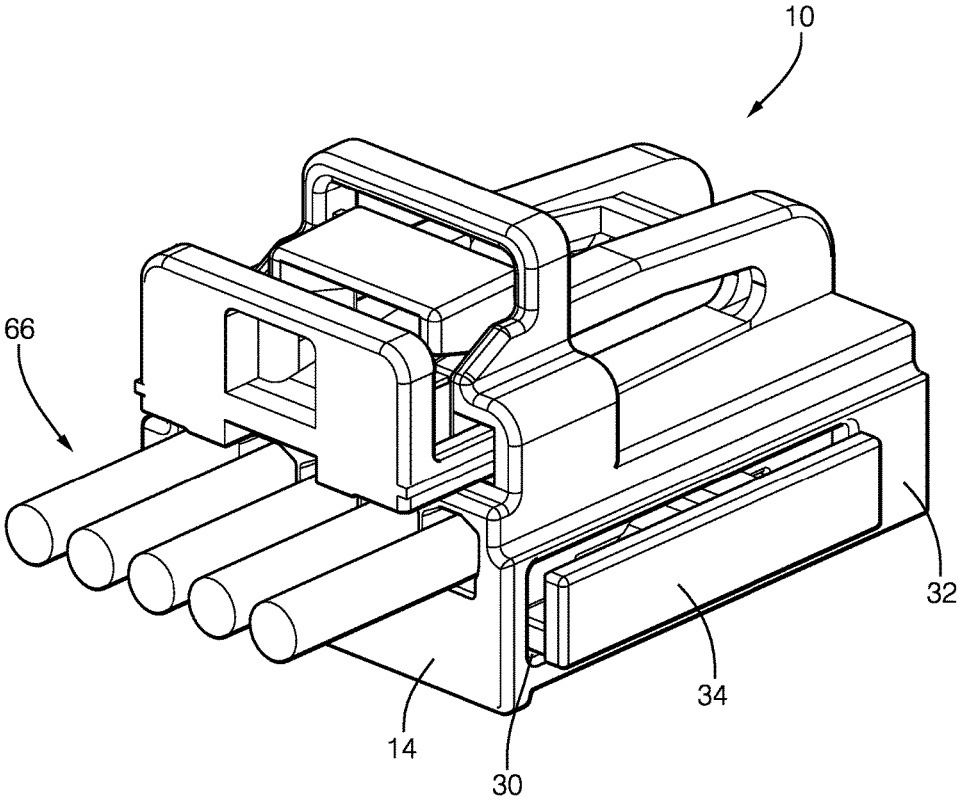
FIG. 1 is a perspective exploded view of an electrical connector including a movable terminal position assurance (TPA) device and a corresponding mating electrical connector in accordance with one embodiment.
Figure 2:
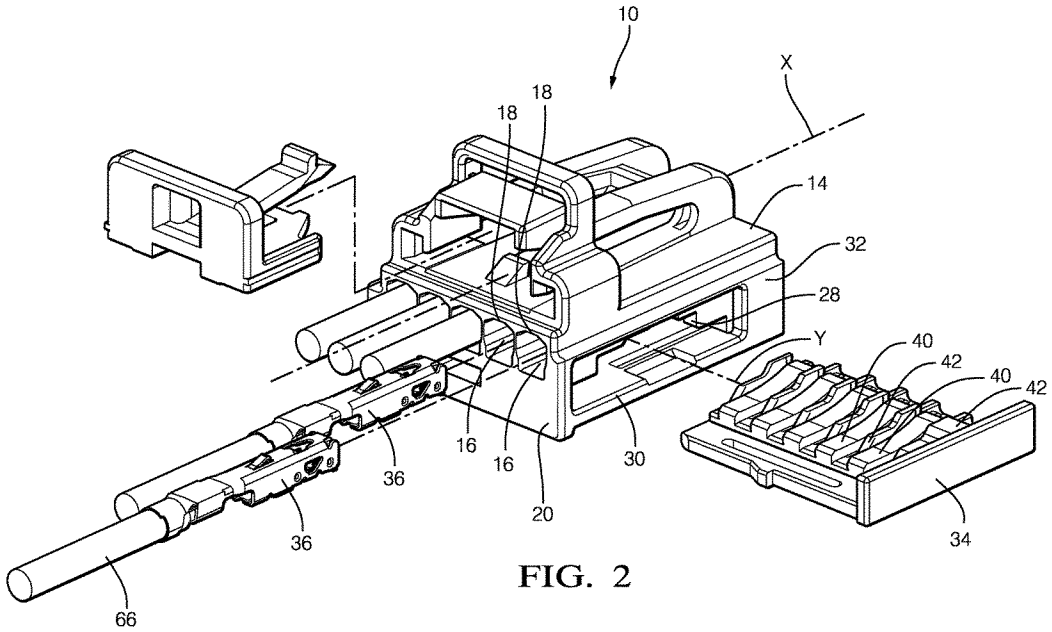
FIG. 2 is a exploded perspective view of the electrical connector of FIG. 1 including the TPA device in accordance with one embodiment.

Presented herein is an electrical connector including a moveable terminal position assurance (TPA) device. The TPA device secures the contacts or terminals of the connector within cavities in the connector housing once the terminals are fully inserted within the housing. The TPA device incorporates a flexible primary lock finger to engage a lock ridge of a terminal thus locating and securing the terminal within a cavity as the terminal is inserted into the cavity while the TPA device is in a terminal insertion position. After insertion of all the terminals into the cavities of the connector housing, the TPA device is moved to a terminal locking position. This movement to the terminal locking position engages a rigid secondary lock on the TPA device with the lock ridge of the terminal in addition to the primary lock finger to further secure the terminal within the cavity.

By cross-referencing FIGS. 1-7, details of a non-limiting example of an electrical connector 10 can be seen. The electrical connector 10 is configured to mate with a corresponding mating connector (not shown). A connector housing 14 of the electrical connector 10 has a first and second internal cavity, hereinafter referred to as a terminal cavities 16 that extends along a longitudinal axis X of the connector housing 14 from an opening 18 in a first face 20, hereinafter referred to as an insertion end 20, of the connector housing 14 to an opening 22 into an integral socket 24 in a second face 26, hereinafter referred to as a mating end 26, of the connector housing 14. The connector housing 14 also has third internal cavity 28 that extends along a lateral axis Y of the connector housing 14 that is transverse, or generally perpendicular, to the longitudinal axis X. As used herein, generally perpendicular is ±10° of absolutely perpendicular. This third internal cavity 28 defines an opening 30 in a lateral wall 32 of the connector housing 14 that is configured to receive a terminal position assurance (TPA) device 34 that is configured to secure electrical terminals 36 within the terminal cavities 16 once the terminals 36 are fully inserted within the terminal cavities 16.

The TPA device 34 is formed of a dielectric polymeric material, such as polyamide, polypropylene, or polybutylene terephthalate. At least one wall 38 of the terminal cavities 16 is open to and in communication with the third internal cavity 28, hereinafter referred to as a TPA cavity 28. The TPA device 34 is movable within the TPA cavity 28 from an terminal insertion position 39 in which the TPA device 34 is disposed before the terminal 36 is inserted into the terminal cavity 16 to a terminal locking position 41 in which the TPA device 34 is disposed after the terminal 36 is fully inserted within the terminal cavity 16.

Figure 3:
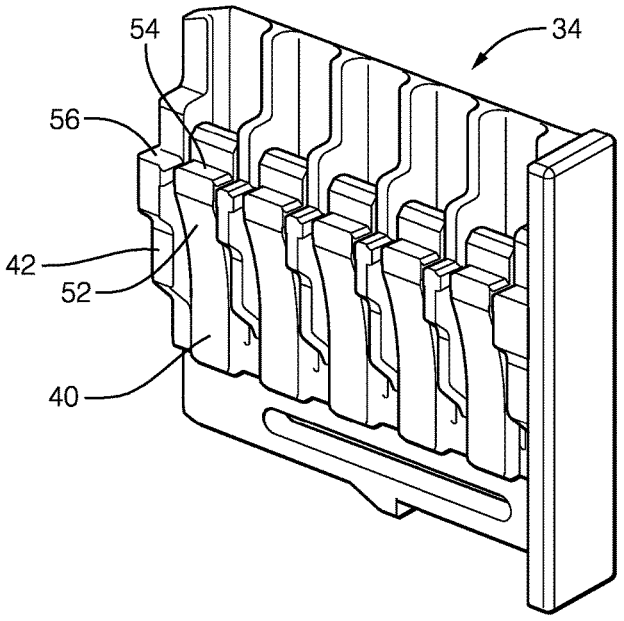
FIG. 3 is a perspective top view of the TPA device of FIG. 1 in accordance with one embodiment.

As shown in FIG. 3, the TPA device 34 includes flexible primary locking features 40 and rigid secondary locking features 42 each configured to secure the terminals 36 within the terminal cavities 16. The secondary locking features 42 are laterally adjacent the primary locking features 40 respectively. The TPA device 34 and the TPA cavity 28 are configured so that the TPA device 34 slides laterally within the TPA cavity 28. The primary locking features 40 include flexible beams 44 that are attached at one end to the TPA device 34. The flexible beams 44 extend along the longitudinal axis X. An unattached end 50 of each flexible beam 44 defines a ramp 52 that slopes toward the insertion end 20 of the connector housing 14. The ramp 52 leads to a lock shoulder 54 that is preferably, but not necessarily, set at a slight back angle.

Figure 4:
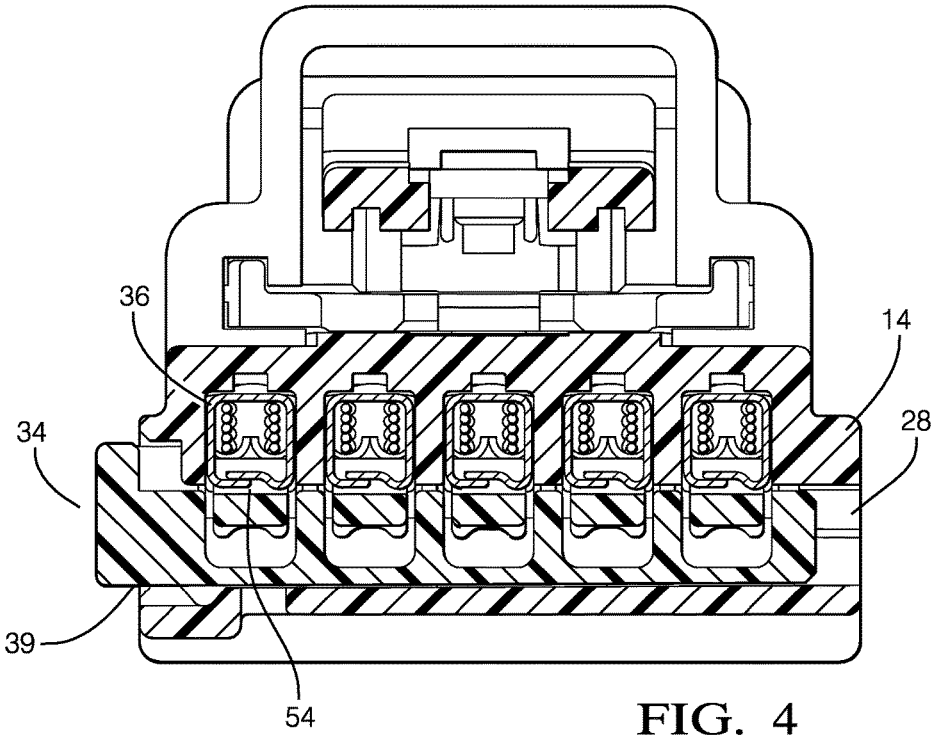
FIG. 4 is a lateral cross sectional view of the electrical connector of FIG. 1 with the TPA device in a terminal insertion position in accordance with one embodiment.

As best shown in FIG. 4, the primary locking features 40 are centered within the terminal cavities 16 when the TPA device 34 is in the terminal insertion position 39.

Figure 6:
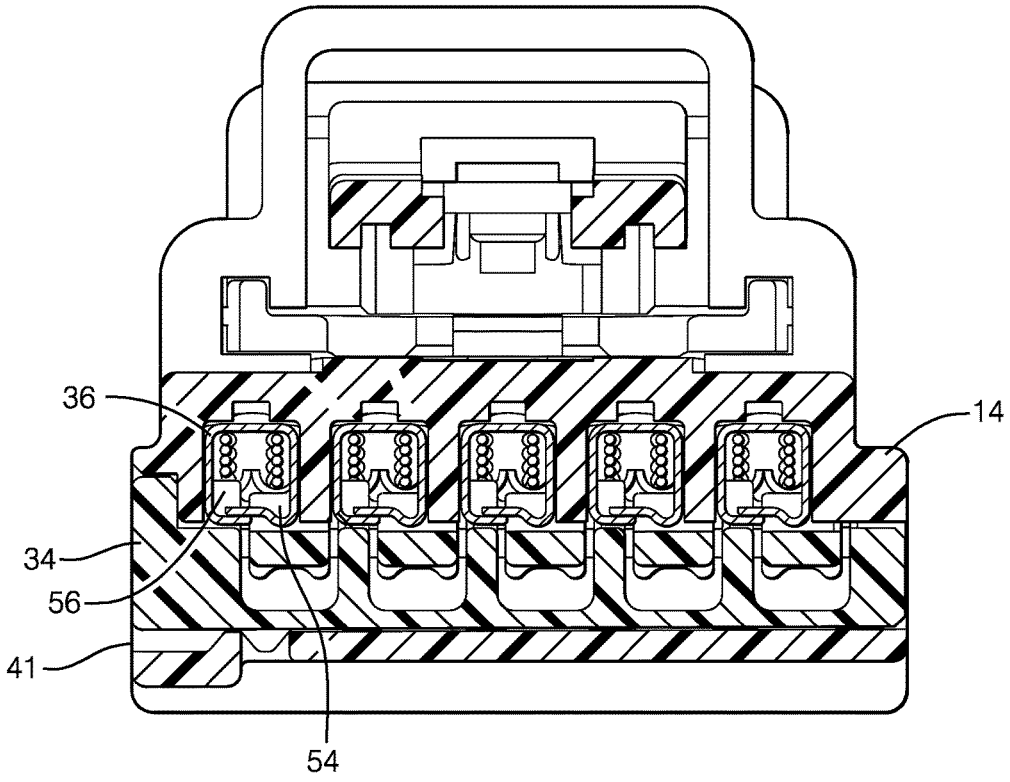
FIG. 6 is a lateral cross sectional view of the electrical connector of FIG. 1 with the TPA device in a terminal locking position in accordance with one embodiment.
Figure 7:
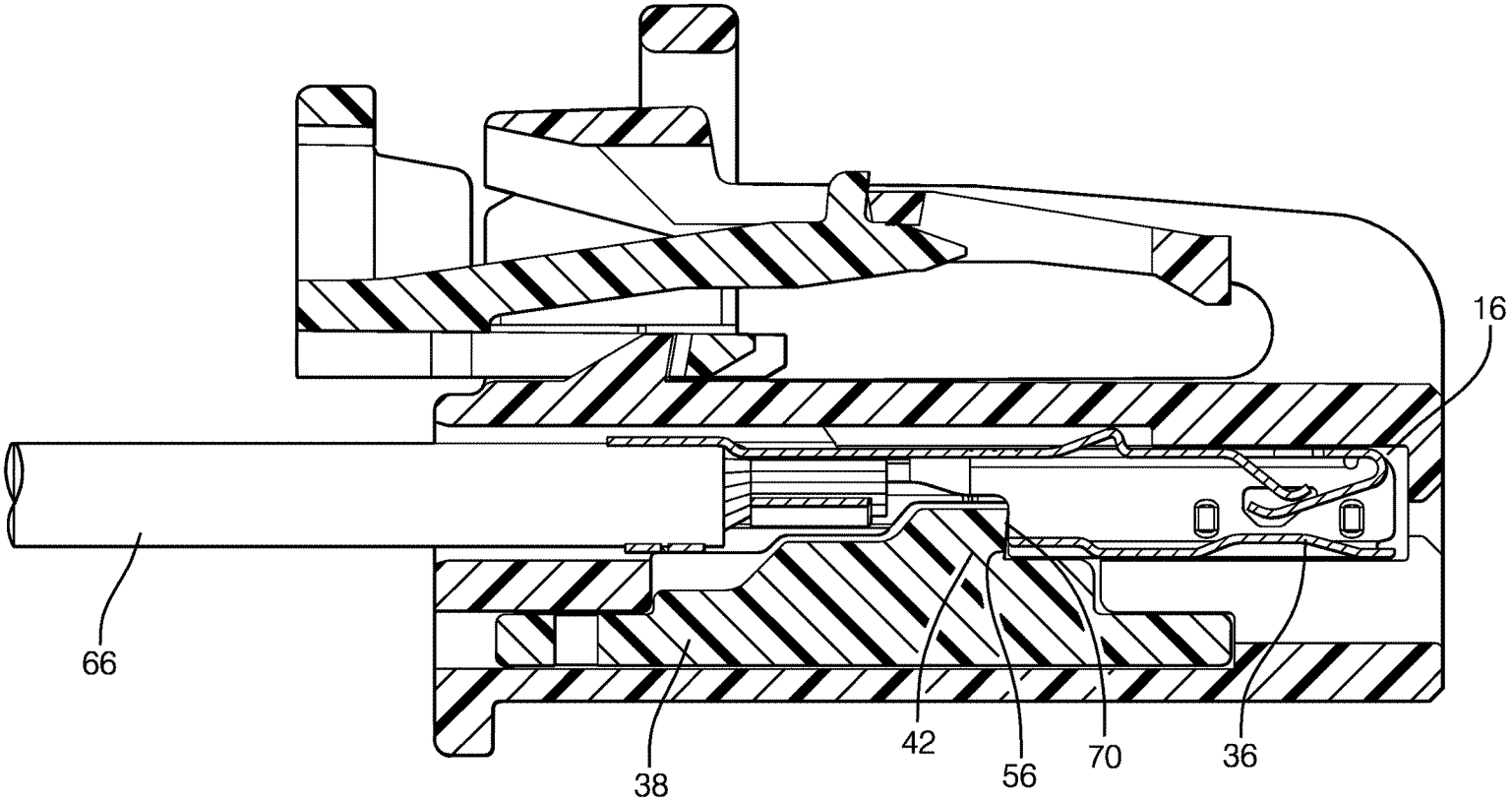
FIG. 7 is a longitudinal cross sectional side view of the TPA device of FIG. 1 engaging the electrical terminal while the TPA device is in the terminal locking position of FIG. 6 in accordance with one embodiment.

The secondary locking feature 42 of the TPA device 34 has a rigid second lock shoulder 56 defined by the TPA device 34. As best shown in FIG. 6, the secondary locking features 42 are laterally offset within the terminal cavities 16 when the TPA device 34 is in the terminal locking position 39.

Figure 5:
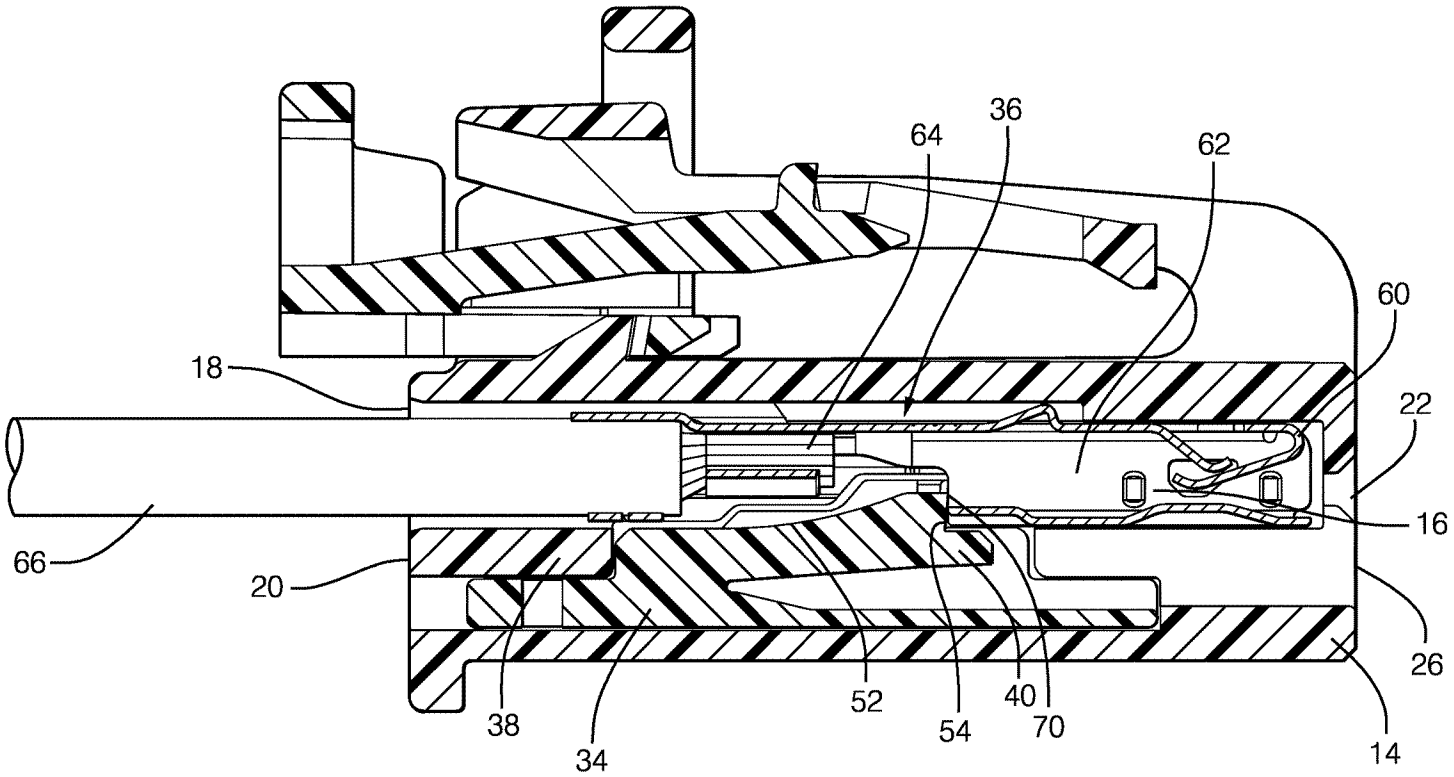
FIG. 5 is a longitudinal cross sectional side view of the TPA device of FIG. 1 engaging the electrical terminal while the TPA device is in the terminal insertion position of FIG. 4 in accordance with one embodiment.

Focusing now on typical electrical terminals 36, which generally include a forward contact portion 60, an intermediate body portion 62, and a rearward attachment portion 64 for attaching the terminal 36 to the insulated conductor wire 66. The body portion 62 leads to a locking surface 70. The terminals 36 are inserted into the terminal cavities 16 through the openings 18 at the insertion end 20 of the connector housing 14 when the TPA device 34 is in the terminal insertion position 39. As best shown in FIG. 5, when body portion 62 engages the ramp 52 of the flexible beam 44, the body portion 62 deflects the flexible beam 44 downwardly so that the ramp 52 of the flexible beam 44 rides over body portion 62 as the terminal 36 is further inserted within the TPA cavity 28. When the lock shoulder 54 reaches the locking surface 70, the flexible beam 44 springs back to a generally undeflected position and the lock shoulder 54 of the flexible beam 44 engages the locking surface 70 of the terminal 36, inhibiting the terminal 36 from being pulled back out of the insertion end 20 of the connector housing 14. The first lock shoulder is generally centered on the locking surfaces 70, i.e. the primary locking features 40 engage a mesial portion of the lock surfaces.

After the terminals 36 are fully inserted into the terminal cavities 16 and secured within the terminal cavities 16 by the primary locking features 40, the TPA device 34 is laterally moved within the TPA cavity 28 from the terminal insertion position 39 to the terminal locking position 41. The secondary locking features 42 are moved into the terminal cavities 16 so that the rigid second lock shoulder 56 now engages asp portion of the locking surfaces 70 of the terminals 36 and is laterally offset on the locking surfaces 70, i.e. the secondary locking features 42 engage a first distal portion of the locking surfaces 70.

As the TPA device slides from and the terminal insertion position 39 to the terminal locking position 41, the primary locking features 40 are moved laterally so they are offset in the terminal cavities 16 and now engage a second distal portion of the locking surfaces 70 of the terminals 36.

As illustrated in FIGS. 1-7, the connector housing 14 includes multiple terminal cavities 16, so the TPA device 34 is positioned in the terminal insertion position 39 where the primary locking feature 40 holds each terminal 36 within its terminal cavity 16 until all of the terminals 36 are inserted into the terminal cavities 16. Once all of the terminal cavities 16 are filled, the TPA device 34 is moved into the terminal locking position 41 so that the terminals 36 are held within the terminal cavities 16 by the secondary locking feature 42.

Each terminal 36 is removable secured in its terminal cavity 16 because the terminal 36 can be removed from the terminal cavity 16 by inserting a tool (not shown) into an access slot and depressing the primary locking feature 40 until the locking surface 70 is released by the lock shoulder 54 when the TPA device 34 is in the terminal insertion position 39. When the TPA device 34 is in the terminal locking position 41, the terminals 36 cannot be removed from the cavity 16 even if the locking surface 70 is released from the lock shoulder 54 because the removal path of the terminal 36 through the cavity 16 is blocked by the secondary locking feature 42, therefore the terminals 36 are irremovably secured within the terminal cavities 16.

While the electrical connector 10 shown in FIGS. 1-7 is designed to contain female terminals 36, the TPA device 34 can also be adapted for use in the corresponding mating connector designed to contain male terminals.

Accordingly, an electrical connector 10 including a TPA device 34 is provided. The TPA device 34 has the benefit of rigidly engaging a locking surface 70 of the terminals 36 when the secondary locking features 42 are engaged, irremovably locking the terminals 36 within the terminal cavities 16. The TPA device 34 also provides a reduction of positional float of the terminals 36 within the terminal cavities 16 which greatly improves the alignment of the terminals 36 within the connector housing 14 and reduces the chance of terminal push-out and/or terminal damage during connection with the corresponding mating connector. Because the primary locking features 40 are only required to hold the terminals 36 within the terminal cavities 16 during the terminal insertion process, the primary locking features 40 may be designed to optimize the terminal insertion force without regard to final retention force since that is separately provided by the secondary locking features 42. The electrical connector 10 also provides the benefit of having the same primary and secondary locking features 40, 42 in each cavity 16 of the connector.

According to engineering evaluation of the design of this electrical connector 10, it has been determined that a terminal retention force for 1.5 mm terminals exceeded automotive OEM performance specification requirements by 62% to 124% when removable secured. The performance of the electrical connector 10 exceeded the terminal pull out force performance of prior art electrical connector designs without the TPA device by 28% to 56% when irremovably secured. Similar performance improvements for 0.64 mm terminals are also expected.

The TPA device 34 is compatible with most polarized tangless (i.e. "clean body") terminals which are defined by automotive OEMs as cavity compatible strategy terminals, e.g. Kaizen 0.64, Delphi MTS, OCS 1.5, OCS 2.8.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical connector, comprising:

a first electrical terminal and a second electrical terminal;

a connector housing defining a first cavity and a second cavity extending along a longitudinal axis from a first face of the connector housing to a second face of the connector housing in which the first and second electrical terminals are disposed, said connector housing defining a third cavity in communication with the first and second cavities and extending along a lateral axis transverse to the longitudinal axis and;

a terminal position assurance (TPA) device disposed within the third cavity and moveable from a terminal insertion position to a terminal locking position, said TPA device comprising flexible first and second primary locking features configured to engage corresponding locking surfaces of the first and second electrical terminals respectively when the TPA device is in the terminal insertion position within the third cavity, said TPA device further comprising rigid first and second secondary locking features configured to engage corresponding locking surfaces of the first and second electrical terminals respectively, wherein only the first primary and first secondary locking features engage the locking surface of the first electrical terminal when the TPA device is in the terminal locking position and wherein only the second primary and second secondary locking features engage the locking surface of the second electrical terminal when the TPA device is in the terminal locking position.

2. The electrical connector according to claim 1, wherein an engagement of a first primary locking feature with the locking surface of the first electrical terminal and an engagement of a second primary locking feature with the locking surface of the second electrical terminal is effective to removably secure the first and second electrical terminals within the first and second cavities respectively.

3. The electrical connector according to claim 2, wherein the engagement of a first secondary locking feature with the locking surface of the first electrical terminal and the engagement of a second secondary locking feature with the locking surface of the second electrical terminal is effective to irremovably secure the first and second electrical terminals within the first and second cavities respectively.

4. The electrical connector according to claim 1, wherein the TPA device is configured to move from the terminal insertion position to the terminal locking position along the lateral axis and move transversely relative to the longitudinal axis.

5. The electrical connector according to claim 4, wherein the TPA device is configured to be inserted in the third cavity transversally to the first and second cavities through a lateral opening defined by the connector housing.

6. The electrical connector according to claim 1, wherein the first and second primary locking features each comprises a flexible beam that is attached at one end to a cross bar of the TPA device and wherein a free end of the flexible beam defines a first lock shoulder.

7. The electrical connector according to claim 6, wherein the first and second secondary locking features of the TPA device each defines a rigid second lock shoulder defined by the cross bar of the TPA device.

8. The electrical connector according to claim 7, wherein the first lock shoulder engages the locking surface of the first or second electrical terminal when the TPA devices is in the terminal insertion position and in the terminal locking position.

9. The electrical connector according to claim 8, wherein the second lock shoulder engages the locking surface of the first or second electrical terminal when the TPA devices is in the terminal locking position.

10. A wire harness assembly, comprising:

an electrical connector according to claim 1; and first and second wire cables connected to the first and second electrical terminals respectively.

* * * * *